US005309585A

United States Patent [19]

Hochschild, III

[11] Patent Number: 5,309,585

[45] Date of Patent: May 10, 1994

[54] DRAIN FITTING FOR WATERBED MATTRESSES

[76] Inventor: Arthur A. Hochschild, III, 7274 Lampson Ave., Garden Grove, Calif. 92641

[21] Appl. No.: 77,656

[22] Filed: Jun. 17, 1993

[51] Int. Cl.[5] ..... A47C 27/08

[52] U.S. Cl. ..... 5/451; 5/918; 138/103; 138/110; 141/65

[58] Field of Search ..... 5/451, 450, 453, 918; 141/65; 138/103, 110

[56] References Cited

U.S. PATENT DOCUMENTS

| | | | |
|---|---|---|---|
| 790,971 | 5/1905 | Nicholls | 138/DIG. 8 |
| 4,332,044 | 6/1982 | Houk, Jr. | 5/453 |
| 4,509,218 | 4/1985 | Rhoton | 5/450 |
| 5,036,890 | 8/1991 | Whaley | 138/103 |
| 5,090,075 | 2/1992 | Larson | 5/451 |
| 5,203,808 | 4/1993 | Ide | 5/918 |
| 5,226,186 | 7/1993 | Boyd | 5/451 |

*Primary Examiner*—Alexander Grosz

[57] ABSTRACT

A waterbed structure including a frame with a horizontal rectangular mattress-supporting platform and vertical retaining boards about the perimeter of the platform; a water-filled mattress of soft flexible sheet material having a horizontal bottom wall supported atop the platform, vertical side walls in supported engagement with the boards and a horizontal top wall; a drain fitting through which water in the mattress can be drained and including an elongate normally horizontal flexible drain tube with inner and outer ends and positioned between a selected one of the side walls of the mattress and its related board, a tubular neck at the inner end of the drain tube and fixed to said one side wall about a drain opening therein, an elongate spacer part with an outer end connected with the neck and projecting horizontally through the drain opening and into the mattress above and adjacent to the bottom wall, said spacer part defines a longitudinal flow passage and longitudinally spaced fluid-conducting openings; and, a closure part releasably engaged with the outer end of the drain tube.

16 Claims, 3 Drawing Sheets

M
F
2
D
12
2
B
23
B
12
S'
-10-
11
14
12
12
B
P
B

23
D
F
B
24
20
E
12
22
S'
3
3
M
11
P

C
T
D
23
E

C'
S
23
D
24
21
20
12
22
M
S'
11
P

S
23
M
21
22
S'
12
10
11
P

T''
T'
23'
24'
20'
S''

S
D
23
12
M
F
B
S'
11
20
24
P

DRAIN FITTING FOR WATERBED MATTRESSES

This invention has to do with the art of waterbeds and is particularly concerned with a waterbed drain fitting.

BACKGROUND OF THE INVENTION

Common waterbed mattresses are large bladders made of soft, flexible and supple water-impermeable sheet plastic in which a suitable volume of water or other desired fluid medium is deposited. In practice, such mattresses are supported by frames that include horizontal platforms that support bottom walls of the mattresses and that include vertical side and end walls about the perimeters of the platforms and that support related side and end walls of the mattresses. When filled with a desired volume of water, the mattresses are inflated so that top walls thereof occur on horizontal planes, spaced above the bottom walls thereof, and that are near or substantially coincidental with the top planes of their related frames, defined by upper edges of the side and end walls thereof.

When waterbed mattresses of the general character referred to above are filled with water, they are extremely heavy and are such that they cannot be easily and safely moved. Accordingly, when waterbeds are to be moved (whether during installation or removal), the mattresses must be drained of water.

Ordinary or conventional waterbed mattresses are provided with filler fittings to facilitate filling them with water and through which water can be drained from the mattresses, as circumstances require. The filler fittings are engaged through and carried by the top walls of the mattresses, where they are accessible. The most common filler fittings have threaded necks with which garden hoses or the like can be connected to facilitate filling and draining the mattresses. When draining water from such mattresses, it can sometimes be let to drain by gravity, but more often, is extracted from the mattresses by means of aspirator pumps or the like that are engaged in the drain hoses and driven by water from a pressurized water service system.

The draining of water from waterbed mattresses, as noted above, has proven to be unsatisfactory since an inadequate amount of water within the mattresses can be drained or extracted therefrom before the collapsing mattress structure commences to interfere with and prevent desired draining of the mattresses. During the draining of water from such mattresses, the mattresses collapse and the thin flexible sheet material of which they are formed tends to wrinkle and fold to establish cavities and/or pockets in which water is retained. The slack plastic sheet material tends to move across and close off or seal the opening in the filler fitting before sufficient water is drained from the mattresses to allow them to be easily and effectively moved. The tendency for the thin plastic material of which the mattresses are made to close and seal the openings through which water is drained is greatly increased when pumping means are employed to extract water from the mattresses. In most instances, the draining of water from such mattresses is stopped or adversely impeded by the mattress structure when about two to four gallons of water weighing from 125 to 250 pounds remains in the mattresses. Thus, the mattresses are still too heavy and difficult for ordinary persons to move. To effect draining the remainder of the water from the mattresses, the mattresses must be manually pulled, lifted and otherwise tugged at in an effort to unstop these drain openings and to direct and/or chase the water that remains in the mattresses to these drain openings. The foregoing is a time-consuming, difficult and bothersome process that oftentimes causes persons to abandon the process when excessive water still remains in the mattresses.

It is to be noted that complete draining of water from the mattresses, when the mattresses are to be moved, is not only for the benefit of those who must manipulate the mattresses, but is to prevent damage to the mattresses. Pulling and dragging ordinary waterbed mattresses over the corners and edges of waterbed frames and the like, when the mattresses are loaded with 100 or more pounds of water is highly likely to result in tearing and/or rupturing the mattresses and must be avoided.

In the mid-1970s, a special class of drain fittings for waterbed mattresses was introduced into the waterbed art. Those fittings are sometimes referred to as "snorkel fittings" or "goose-neck fittings." Those drain fittings are connected with their related mattresses at the lower edge portions of related vertical side walls thereof and include elongate tubular necks of sufficient length to extend vertically upwardly to above the top plane of the mattresses. The necks of those fittings normally extend horizontally along the exterior of their related side walls of the mattresses and are sufficiently flexible so that they can be bent upwardly to project above the mattresses and connect with drain hoses, when draining of the mattresses is to be undertaken.

The above-noted drain fittings are such that they open into their related mattresses immediately above the bottom walls thereof and drain water from the bottoms of the mattresses, rather than from the tops of the mattresses, as is the case when draining water from the mattresses through their filler fittings. Accordingly, these noted drain fittings tend to effect the draining of a greater portion of the water from their related mattresses before portions of the mattresses move into interfering and disabling engagement therewith.

The advantages afforded by the above-noted special drain fittings has been determined by many to be insufficient to merit the provision and use thereof and they have failed to meet with any notable commercial success.

It is to be noted that the above-noted special drain fittings are still provided on mattresses produced by some waterbed manufacturers but are considered by most in the art to be of insufficient utility to be more than a sales promoting feature.

It has been determined that when the above-noted goose-neck or snorkel type drain fittings are used in combination with aspirator pumps and the inlet ends of the fittings are covered and sealed by portions of the mattresses, the pumps collapse the tubular necks of the fittings and prevent further draining of the mattresses. In order to restart the draining operations, the water supply to the aspirator pumps must be shut off to relax and permit the necks to reopen, the mattresses must be pulled and tugged at to displace the interfering mattress materials from overlying the fittings; and, the water supply must be once again turned on to continue draining the mattresses. As a general rule, the foregoing time-consuming and inconvenient procedure must be repeated a number of times before the mattresses are adequately drained of water.

PRIOR ART

The most pertinent prior art of which I am aware are those molded plastic goose-neck or snorkel-type drain fittings for waterbed mattresses noted in the preceding and which form a part of my invention.

OBJECTS AND FEATURES OF MY INVENTION

It is an object of my invention to provide an improved goose-neck or snorkel type drain fitting for waterbed mattresses.

Another object of my invention is to provide a fitting of the general character referred to above that is not subject to being stopped and prevented from functioning by the closing of its inlet end by the movement of parts of its related mattress structure into interfering and disabling engagement therewith.

Yet another object of my invention is to provide an improved fitting of the general character referred to above which is such that it is not subject to being collapsed and rendered inoperative by minus pressures imposed upon it by a related pump means provided to extract water from its related mattress.

It is an object and feature of my invention to provide a goose-neck type drain fitting as provided by the prior art with spacer means projecting from its inlet end into its related waterbed mattress to hold adjacent walls of the mattress from moving into interfering and disabling relationship with the inlet end of the fitting and to maintain those walls of the mattress in spaced relationship from each other so as not to prevent the flow of water therebetween and to the fitting.

Still another object and feature of my invention is to provide an improved drain fitting of the general character referred to above including flexible internal support means to prevent collapsing of parts and/or portions of the fitting when the fitting is subjected to internal minus pressures generated by a related pump means.

Another object and feature of my invention is to provide an improved drain fitting of the general character referred to above wherein the spacer means is an elongate helical spring with an outer end portion engaged within the inlet end portion of the fitting and an inner portion that projects inwardly from the fitting to occur between and to maintain adjacent wall portions of the mattress, about the fitting, in spaced relationship with each other.

It is another object and feature of my invention to provide an improved drain fitting of the character referred to above wherein the internal support means includes an elongate helical spring with inner and outer ends and engaged in and extending longitudinal of an elongate flexible tubular portion of the fitting.

Finally, it is an object and a feature of my invention to provide an improved drain fitting of the general character referred to above wherein the outer end of the spacer means spring and the inner end of the support means spring are in hooked engagement with each other to prevent inward movement and displacement of the spacer spring and outward movement and displacement of the support spring.

The above and other objects and features of my invention will be apparent and will be fully understood from the following detailed description of my invention throughout which description reference is made to the accompanying drawings.

DETAILED DESCRIPTION OF THE INVENTION

Figure 1:
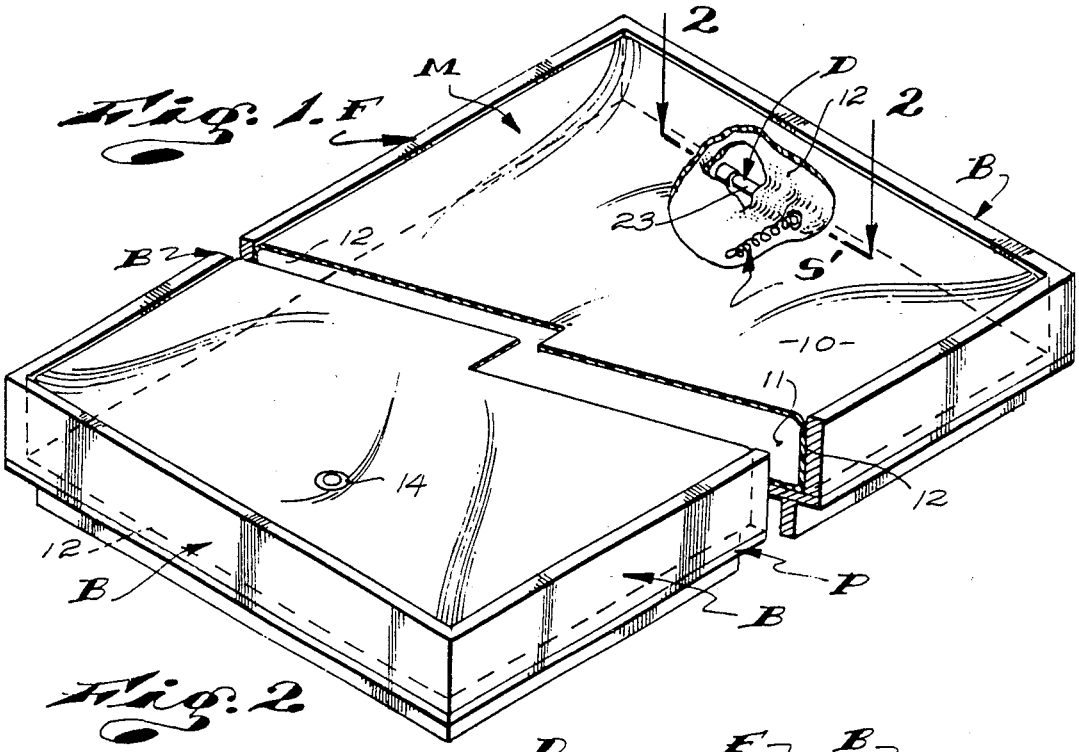
FIG. 1 is an isometric view of a waterbed structure including my new drain fitting.
Figure 2:
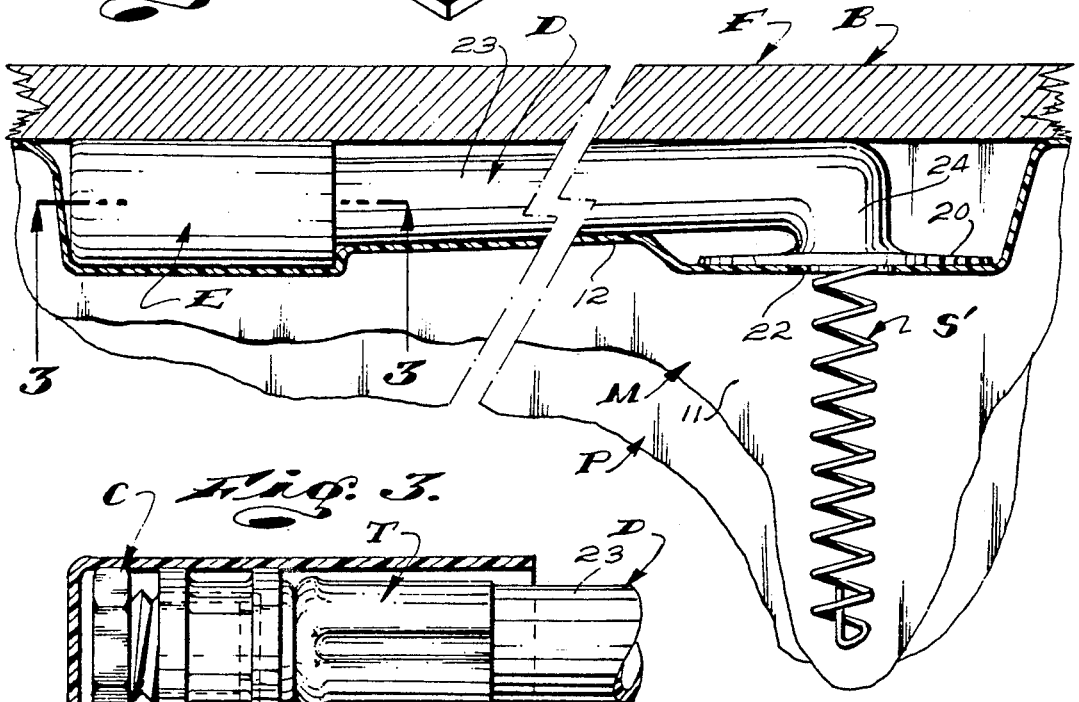
FIG. 2 is an enlarged sectional view taken substantially as indicated by Line 2—2 in FIG. 1.

In FIG. 1 of the drawings, I have shown my new goose-neck type drain fitting D related to a conventional waterbed mattress M within a conventional waterbed frame F.

The frame F includes a flat horizontal rectangular platform P with side and and end edges and suitably supported atop a floor or deck. The frame next includes vertical, upwardly projecting side boards B extending longitudinally of the several sides of the platform P. In practice, the boards B that extend along the longer sides of the platform are referred to as side boards and the boards that extend along the short sides of the platform are referred to as head and foot boards. In practice, my new fitting D can be related to any one of the several sides of the frame F and the mattress M. Accordingly, I will describe my fitting as being related to one side board B of the frame and to a related side wall of the mattress M without designating what side board or side wall it might be.

The mattress M is shown as a simple bladder-like unit established of thin flexible and supple sheet plastic material such as polyvinylchloride. The mattress has flat horizontal top and bottom walls 10 and 11 and vertical side walls 12 about the perimeter of and extending between related side edge portions of the top and bottom walls. The top wall 10 is provided with and carries a filler fitting 14 to facilitate filling the mattress with a desired volume of water or other suitable fluid medium.

The mattress M is arranged atop the platform P of the frame within the confines of the side boards B and is filled with water until the top wall 10 thereof is floated up to a horizontal plane that is suitably close to the top plane of the frame F that is defined by the upper edges of the side boards B thereof (as shown in FIG. 1 of the drawings).

The bottom wall 11 and side walls 12 of the mattress M are urged and held in tight bearing and supported engagement with the top surface of the platform P and the inside surfaces of the several boards B by the water therein.

Most mattresses are established of top and bottom sheets of plastic thermally welded together about their perimeters. The central portions of the two sheets of plastic define the top and bottom walls 10 and 11 and the perimeter edge portions thereof, when the mattresses are filled with water, define the side walls of the mattress. Accordingly, in most instances, the mattresses are not made with structurally definable side walls but are such that when positioned within their related bed frames and filled with water they are formed to establish definable vertical side walls.

When filled with water, most standard waterbed mattresses vary between 8" and 10" in vertical extent or depth and have or define vertical side walls 12 that extend longitudinally of and have upper and lower edge portions that meet or join with related side edges of the top and bottom walls 10 and 11.

It is to be understood that the construction of the frame F and of the mattress M can vary widely without in any way departing from or affecting the broader aspects and spirit of my invention and that the form of mattress structure illustrated and briefly described above is but one form of waterbed mattress with which my new drain fitting D can be advantageously related.

Figures 4, 5, 6, 7:
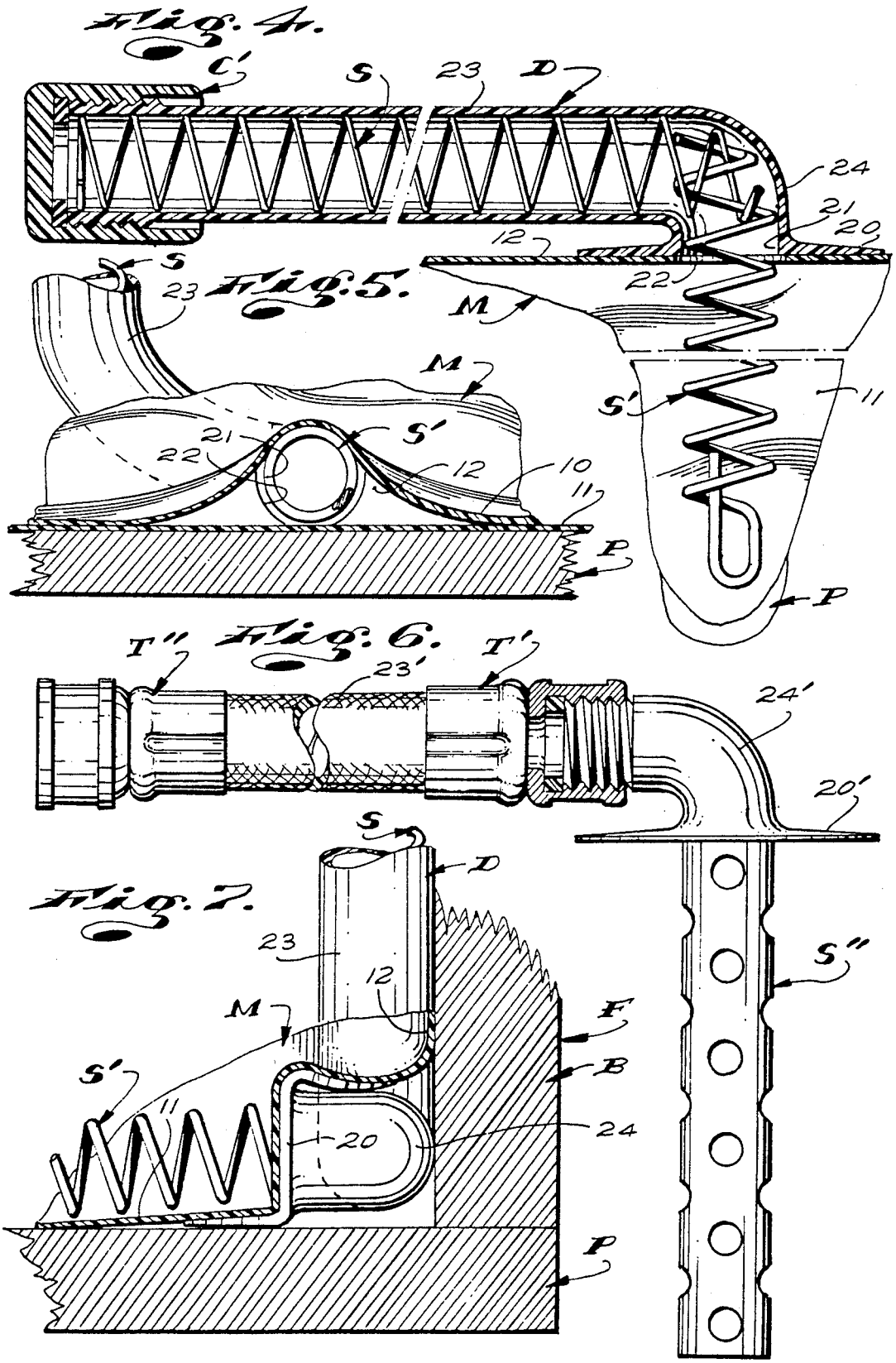
FIG. 4 is a horizontal sectional view of a preferred embodiment of the invention.
FIG. 5 is a horizontal sectional view taken through my new spacer means.
FIG. 6 is a view showing another embodiment of the invention.
FIG. 7 is a sectional view showing the form parts of the fitting assume when in use.

My new drain fitting D is positioned and engaged with the lower edge portion of a related vertically disposed side wall 12 of the mattress M and occurs between and is normally securely held between that side wall and its adjacent board B of the bed frame F, as clearly shown in FIG. 7 of the drawings. The fitting D, as shown, occurs immediately above the top planes of the platform P of the frame F and bottom wall 11 of the mattress M.

The drain fitting D includes a normally flat, normally vertical flexible mounting plate 20 with a central opening 21 that is in flat bearing engagement with and is thermally welded or otherwise secured to the exterior surface of the side wall 12 with the opening 21 therein in register with a drain opening 22 formed in the side wall.

The fitting D next includes an elongate normally horizontal drain tube portion 23 with inner and outer ends that is positioned between the side wall 12 of the mattress and the board B. The fitting D next includes a tubular neck portion 24 at the inner end of and on an axis at right angle to the axis of the tube 23. The neck 24 has an outer end joined integrally with the inner end of the tube 23 and an inner end joined with an outer surface of the plate 20, concentric with the opening 21 therein.

Figure 3:
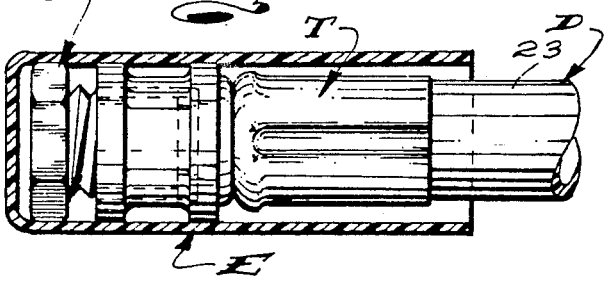
FIG. 3 is a view taken as indicated by Line 3—3 in FIG. 2.

The outer end of the tube 23 is closed by a closure part C when the mattress M is filled with water and put to its intended use. In the case illustrated, the outer end of the tube 23 is provided with a threaded coupling part T with which the part C is threadedly engaged. The coupling part T is preferably a standard female hose coupling part, such as is shown in FIG. 3 of the drawings. The part T is such that when the mattress is to be drained of water, a standard male hose coupling part at the end of a drain hose can be engaged therein. The structure of my new drain fitting D thus far described is indistinguishable from one form of goose-neck type drain fitting provided by the prior art.

But for the hose coupling part at the outer end of the tube 23, the structure thus far described is preferably a unitary part molded of a suitable flexible plastic material that is compatible with and can be effectively welded or otherwise securely mounted on the side wall 12 of the mattress M.

In FIG. 4 of the drawings, I have shown an alternate means at the outer end of the tube 23 to close it and to connect it with a drain hose. This alternative means is shown as including threads formed about the outer end of the tube 23 and a cap C' engaged therewith.

Figure 8:
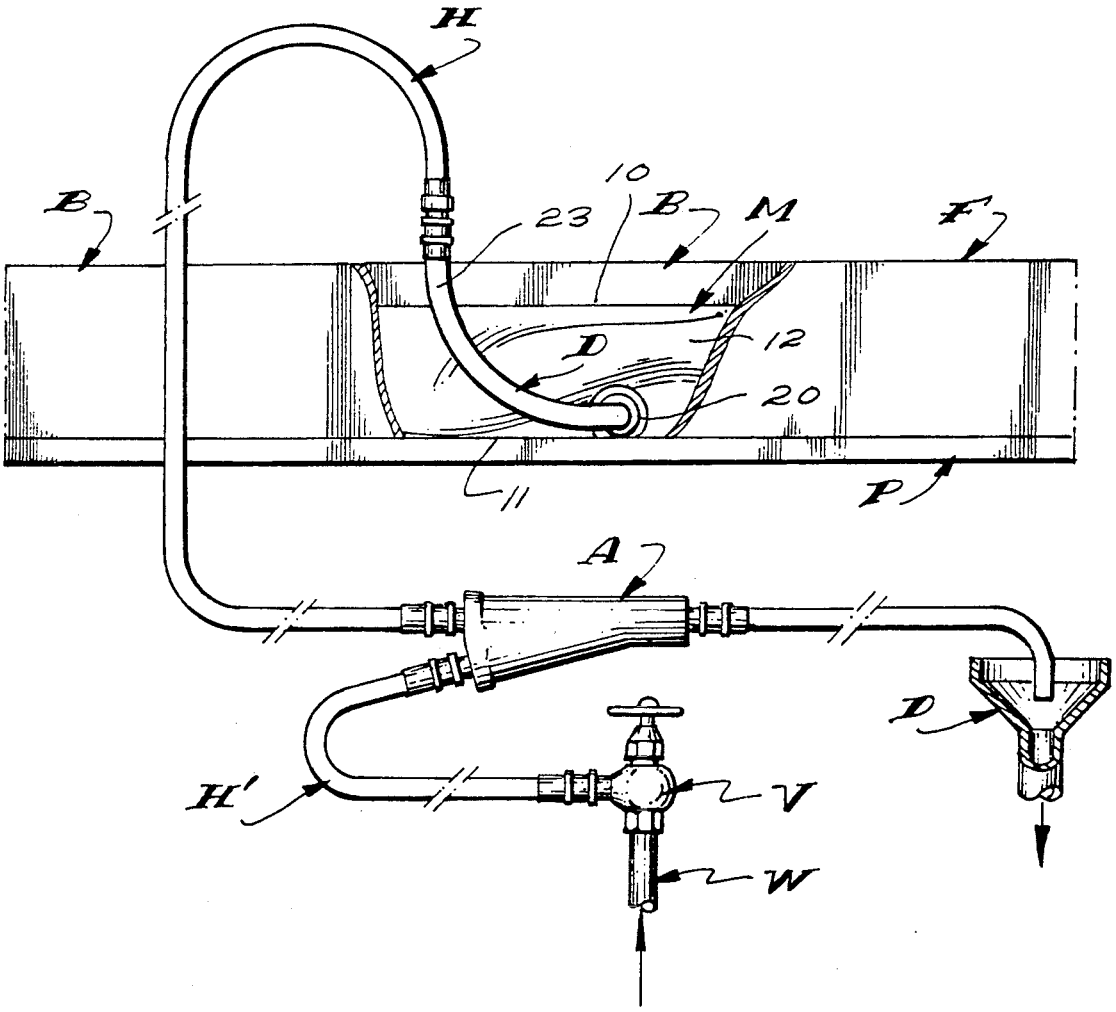
FIG. 8 is a diagrammatic view of my new fitting in combination with related draining means.

The drain tube 23 is sufficiently flexible and is sufficiently long so that when desired, it can be bent upwardly to an upturned position where its outer end is disposed substantially upwardly and occurs above the top plane of the top wall 10 of the mattress and of the frame, as shown in FIGS. 5, 7 and 8 of the drawings.

In furtherance of my invention, the fitting D next includes support means S to support the drain tube 23 and prevent that tube from buckling and crimping when it is bent from its normal horizontal position to its noted upturned position. Without such support means, the tube 23 is highly subject to buckling and crimping when flexed to its upright position. Should that tube buckle or crimp as noted above, the flow of water through it would be stopped and the fitting would be rendered inoperable. Since most of the tube remains concealed between the mattress and its related side board when it is turned to its upturned position, buckling or crimping of the tube cannot be seen and it is often a difficult and troublesome task to locate and undue or release a buckle or crimp in the tube.

It is also to be noted that the drain tube 23 cannot be made so stiff and strong that it will not buckle, crimp or otherwise collapse since if it is made sufficiently stiff and strong to prevent such adverse effects, it is so strong and stiff that it becomes a lever arm that turns the mounting plate 20 and torques (winds up and/or twists) the wall 12 of the mattress at and about the plate 20 when it is turned to dispose its outer end upwardly. Such torquing of the side wall 12 at its joinder with the plate 20 of the fitting D tends to overstress the wall of the mattress and is very likely to cause it to tear. Accordingly, it is highly important that the tube 23 be sufficiently thin, soft and flexible so that it will not adversely torque the side wall 12 of the mattress M when it is flexed to its upturned position.

The support means S that I provide is an elongate helical spring that is substantially equal in longitudinal extent with the tube 23 and that is preferably of such outside diametric extent that its snugly fictionally engages the inside surface of the tube. The weight of the stock from which the spring is made and the pitch of the spring can vary widely without departing from the broader aspects and spirit of my invention. In my reduction to practice of the invention, the wall thickness of the tube 23 is about 1/16"; the inside diameter of the tube and outside diameter of the spring are about $\frac{3}{4}$"; and, the spring is established of 1/32" stainless steel wire stock and has a pitch of approximately 30°. Such a relationship of parts has proven to be quite satisfactory.

In furtherance of my invention, my new drain fitting D includes spacer means S' within and projecting inwardly from the neck 24 and through the plate 20 into the mattress M. The spacer means S' serves to hold the plastic sheet material of which the mattress is made from moving into interfering engagement over and about the opening 21 in the mattress and the inner end of the fitting D. The spacer means S' also projects into the mattress a sufficient distance to maintain the portions of the sheet material of which the mattress is made in spaced relationship from each other in the area or zone of the mattress structure with which the fitting D is related; when the mattress is partially drained of water and as shown in FIGS. 5 and 7 of the drawings.

Without spacer means to maintain portions of the wall structure of the mattress (that occur near to the fitting D) in spaced relationship from each other, there is a great tendency for those portions of the mattress to move into sealing engagement with each other and prevent the flow of water therebetween to the drain fitting. The foregoing problem is greatly exacerbated when a pump means is used to extract water from the mattress through the fitting D since the minus pressure developed by the pump means draws adjacent opposing wall portions of the mattress into sealing engagement with each other and toward the fitting D.

The spacer means S' is an elongate helical spring similar to the spring S. The spring S' has an outer end portion that is fictionally engaged in and through the neck 24 of the fitting.

In practice, I have found that the spring of the means S' is preferably made of heavier wire stock than the spring of means S. For example, 1/16" wire stock has been found to be quite acceptable.

The outer end of the spring S' is releasably coupled with the inner end of the spring S to prevent axially displacement of the springs S and S'. Coupling of the springs is effected by turning the spring S' so that its outermost convolutions or turns are, in effect, screwed into hooked engagement with the innermost convolutions or turns of the spring S. The number of turns at the end of each spring that are screwed into hooked engagement with the turns at the ends of the other spring is dependent upon the weight and pitch of the springs and is subject to some variation. In my reduction to practice of the invention, it has been found that 1½ to 2 turns of the springs S and S' are readily screwed or turned into hooked engagement with each other and that such engagement of the those springs is more than adequate to prevent the springs from becoming displaced.

In operation, when the spring S' is screwed into engagement with the spring S, as noted above, the interengaged portions of the springs are biased and deformed into engagement with each other in a manner substantially as shown in FIG. 4 of the drawings. Such biased engagement of the springs inhibits their free turning out of engagement with each other. The foregoing, plus the fact that the springs are fictionally engaged against turning within their related tubular parts of the fitting renders the springs such that they cannot be disengaged without forcibly turning or unscrewing and drawing the spring S' from engagement with the spring S.

The longitudinal extent of the inner end portion of the spring S' that extends freely into the mattress M can be varied as circumstances require. Upon testing my new fitting, it has been determined that if the inner end portion of the spring S' extends into the mattress M a distance of 4" or 5", there is little likelihood that the walls of the mattress structure near the fitting will interfere with or interrupt draining of the mattress.

In practice, it is preferred that the inner end portion of the spring S' not be made so long that it projects or extends into the mattress a sufficient distance so that it might be engaged by the top wall of the mattress when the top wall of the mattress is moved downwardly by the weight of the person engaged atop the mattress, during normal and intended use of the mattress.

The only circumstances where the inner end portion of the spring S' (when 4" to 5" long) has been found not to function as intended is when the mattress is improperly installed and such that the sheet material establishing the bottom wall of the material has folds or gathers to create upstanding wires across the bottom wall of the mattress and over which water, within the mattress, cannot flow to reach the fitting D.

The first or innermost convolution at the inner end of the spring S is bent recurvantly formed so that the free end of the wire stock of which it is formed is disposed outwardly and terminates within the spring, inward of the innermost full convolutions thereof and such that there is no likelihood that the inner end of the spring might catch and puncture or tear the walls of the mattress structure.

Finally, my invention includes a soft, pliable and supple protective bonnet-like cap E that is removably slidably engaged about the outer end of the tube 23, coupling part T and closure part C. The cap B prevents the likelihood of the parts about which it is engaged from snagging, abrading or otherwise causing harm to the mattress and other parts of the bed structure at and about the outer end portion of the fitting D.

Referring to FIG. 8 of the drawings; when it is desired to drain the mattress M by means of my new drain fitting, the tube 23 is manually turned from its normal horizontal position between its related side wall 12 of the mattress and related board B, to its upturned position. When so positioned, the cap E and the closure part C are removed. Thereafter, a standard male hose coupling part at an end of an elongate drain hose H (garden hose) is coupled with the tube. The hose H extends to and opens at a suitable waste site or means D. The hose H has an aspirator pump A engaged in it (between its ends). The pump A is connected with a valve V of pressurized water supply W by means of motive fluid supply hose H'.

When the above-noted combination and relationship of parts is established, the water supply to the pump A is turned on and the pump operates to draw a minus pressure in the hose H upstream of the pump and to extract or draw water from the mattress M, through the fitting D, and to deliver it to waste. The pump continues to extract or remove water from the mattress uninterruptedly until little more than that residual water that wets the mattress remains therein.

In practice, when mattresses equipped with my new fitting D have been emptied of water in the manner described above, it can be anticipated that one to three pounds of water might be trapped within the mattress, remote from the drain fitting, but seldom is more than five pounds of water is left to remain, unless the mattress was installed in an improper manner.

When the mattress is drained, the water supply to the aspirator pump is shut off; the hose H is disconnected from the fitting D and the closure part is reengaged with the fitting D so that little or no air is allowed to enter the mattress through the fitting D before it is moved and so that the mattress will remain in a fully collapsed condition that makes it most easy and convenient to manipulate and move.

When the last several gallons of water are extracted from the mattress in the manner set forth above, the walls of the mattress are drawn toward each other and start to collapse about the area where the fitting D occurs. The minus pressure drawn by the pump P tends to lower or drop as the foregoing conditions develop. But for the support means S that I provide, the tube 23 of my fitting is highly likely to be collapsed by dropping pressures long before a sufficient volume of water has been drained from the mattress to allow it to be easily and safely moved.

In FIG. 6 of the drawings, I have shown another embodiment of my invention wherein the spring of the spacer means is replaced by a length of perforated plastic tubing S that can be engaged in or formed integrally with the mounting plate 20' and neck 24' of the fitting; and, wherein the drain tube 23' is a short length of flexible reinforced hose with hose coupling part T' at its inner end, connecting it with the neck 24' and a fitting T'' at its outer end to receive a closure part or connect with a hose.

I have determined that while the above modified embodiment of my invention can be made to attain the same ends that my preferred embodiment of the invention attains, the cost of procuring and assembling the necessary added parts exceeds the cost of producing my preferred embodiment of the invention. For example, to provide a suitable reinforced hose section with the necessary couplings to effect its replacement for the tube 23 and spring S of my preferred embodiment of the invention exceeds the cost of forming the tube 23 integrally with the neck 24, applying the female hose coupling part T and inserting the spring S, when establishing my preferred embodiment of the invention. Further, a structure of many fabricated parts increases the possibility of leaks and the like and is less aesthetically pleasing and marketable, as it looks like it was simply Jerry-rigged.

The spacer spring S' in my preferred embodiment of the invention and the perforated spacer tube S'' in the modified embodiment of my invention are both elongate spacer parts that define longitudinally extending central flow passages and each has or defines radial openings communicating with space about those parts and their central flow passages. Accordingly, the two distinct embodiments of spacer means that I have illustrated are equivalent means and each is definable as an elongate spacer part defining a central longitudinal flow passage and having radial openings through it, throughout its longitudinal extent.

In the manufacture of waterbed mattresses appropriately cut pieces of sheet plastic are arranged together with their adjacent edge portions in overlapping relationship and the overlapping edge portions are welded together by induction welding to establish durable water-tight seams. To perform induction welding effectively, no foreign metal, such as metal springs, can be in close proximity to the welding site. Accordingly when practicing my invention, the springs S and S' cannot be in place when those seams of the mattress that are close to the drain fitting are being welded. By making the springs S and S' two parts and relating them to the fitting D and with each other as described above, it is possible to easily and effectively weld all of the seams that are in close proximity to the fitting D (with the springs separated therefrom) and to install the springs in the fitting before one remote and last-to-be-welded seam in the mattress is welded.

Having described only typical preferred forms and embodiments of my invention, I do not wish to be limited to the specific details herein set forth but wish to reserve to myself any modifications and/or variations that might appear to those skilled in the art and which fall within the scope of the following claims.

Having described my invention, I claim:

1. A waterbed structure including a mattress (M) fabricated of thin flexible water-impervious sheet material and including horizontal top and bottom walls (10 and 11) with upper and lower surfaces and vertical side walls 12 with inner and outer surfaces about and extending between perimeter edge portions of the top and bottom walls (10 and 11); a frame (F) including a horizontal platform (P) below the lower surface of and supporting the bottom wall (11) and vertical boards (B) positioned outward of the outer surfaces of and supporting the side walls (12); a volume of water within the mattress normally supporting the top wall (10) on a horizontal plane spaced above the bottom wall (11) and that is close to the horizontal top plane of the frame (F) defined by upper edges of the boards (B); a drain fitting connected with the mattress (M) to drain water therefrom through a drain opening (22) in a lower edge portion of a side wall (12) immediately above the upper surface of the bottom wall (11), said fitting (D) includes an elongate flexible normally substantially horizontally disposed drain tube (23) with inner and outer ends extending parallel with said side wall (12) between said side wall (12) and its related board (B), a tubular neck (24) with inner and outer ends and angularly related to and connected with and between the inner end of the tube (23) and the side wall (12) at the drain opening therein, said tube (23) is selectively manually bendable from its normal horizontal position to an upturned position where its outer end is disposed substantially vertically upwardly and is accessible at the top planes of the mattress (M) and frame (F), coupling means (T) at the outer end of the tube (23) to selectively sealingly couple the outer end of the tube (23) with a closure part (C) and with the inner end of an elongate drain hose (H), and an elongate horizontally disposed spacer part (S') with an outer end at the inner end of the neck (24) and an outer end portion projecting inwardly from the neck (24) through the drain opening (22) and into the mattress (M) across the upper surface of the bottom wall (11) thereof and defining a central longitudinal flow passage communicating with the neck (24) and having radial openings throughout its longitudinal extent and opening into the central flow passage and into the interior of the mattress.

2. The waterbed structure set forth in claim 1 wherein the spacer part (S') is an elongate perforated tube.

3. The waterbed structure set forth in claim 1 wherein the spacer part (S') is an elongate resilient helical spring.

4. The waterbed structure set forth in claim 1 that further includes flexible support means (S) within and extending longitudinally within the drain tube.

5. The waterbed structure set forth in claim 1 wherein the spacer part (S') is an elongate helical spring with an outer portion within the neck (24), and with an inner end portion extending inwardly from the neck (24) and into the mattress (M).

6. The waterbed structure set forth in claim 1 wherein the spacer part (S') is an elongate helical spring that is rotatably advanced outwardly in the neck (24) and into the drain tube (23) where its outermost convolutions interengage convolutions at the inner end of an elongate helical support spring (S) that is positioned within the drain tube (23).

7. The waterbed structure set forth in claim 1 wherein the coupling means (T) at the outer end of the drain tube (23) is a threaded hose coupling unit fixed to and carried by the drain tube (23) and wherein said closure part (C) is a threaded part that is releasably engaged with the coupling means (T) to seal the outer end of the drain tube (23).

8. The waterbed structure set forth in claim 1 wherein the coupling means (T) is a female hose coupling unit fixed to and carried by the drain tube (23) and said closure part (C) is a threaded plug releasably threadedly engaged in the coupling means (T) to seal the outer end of the drain tube (23).

9. The waterbed structure set forth in claim 1 wherein the coupling means (T) is a female hose coupling unit fixed to and carried by the drain tube, said structure further includes an elongate flexible drain hose (H) with inner and outer ends, a male hose coupling unit at its inner end engaged with the coupling means (T), and, a pump means (A) engaged in the drain hose (H) downstream by the drain fitting (D) and moving water from within the mattress (M) through the drain fitting (D) and hose (H) and discharging it to waste.

10. The waterbed structure set forth in claim 1 that further includes an elongate flexible drain hose (H) with inner and outer ends, a hose coupling part at its inner end engaged with the coupling means (T), and, a pump means (A) engaged in the drain hose (H) downstream of the drain fitting (D) and moving water from within the mattress (M) through the drain fitting (D) and hose (H) and discharging it to waste.

11. The waterbed structure set forth in claim 1 wherein said pump means (A) is an aspirator pump connected with a valve-controlled pressurized water supply (W) that delivers motive water to the pump (A).

12. The waterbed structure set forth in claim 1 wherein the coupling means (T) is a female hose coupling unit fixed to and carried by the drain tube (23), said structure further includes an elongate flexible drain hose (H) with inner and outer ends, a male hose coupling unit at its inner end engaged with the coupling means (T), and, a pump means (A) engaged with the outer end of the drain hose (H) and moving water from within the mattress (M) through the drain fitting (D) and hose (H) and discharging it to waste; said pump means (A) is an aspirator pump connected with a valve-controlled pressurized water supply (W) that delivers motive water to the pump means (A); said waterbed structure further includes support means (S) within the drain tube (23) to prevent buckling of the tube when it is bent from its normal horizontal position to its upturned position and that prevents the drain tube (23) from collapsing when subjected to minus pressures generated by the pump means (A), said support means (S) is an elongate resilient helical spring engaged in and extending longitudinally through the drain tube (23).

13. The waterbed structure set forth in claim 1 wherein the coupling means (T) is a female hose coupling unit fixed to and carried by the drain tube (T), said structure further includes an elongate flexible drain hose (H) with inner and outer ends, a male hose coupling unit at its inner end engaged with the coupling means (T), and, a pump means (A) engaged with the outer end of the drain hose (H) and moving water from within the mattress (M) through the drain fitting (D) and hose (H) and discharging it to waste; said pump means (A) is an aspirator pump connected with a valve-controlled pressurized water supply (W) that delivers motive water to the pump means (A); said waterbed structure further includes support means (S) within the drain tube 23 to prevent buckling of the drain tube (23) when it is bent from its normal horizontal position to its upturned position and that prevents the drain tube (23) from collapsing when subjected to minus pressures generated by the pump means (A), said support means (S) is an elongate resilient helical spring engaged in and extending longitudinally through the drain tube (T); said spacer means (S') is an elongate resilient helical spring with an outer end portion engaged through the neck (24) and into the inner end of the drain tube (23) with convolutions at its outer end rotatably advanced into interengaged coupled engagement with convolutions at the inner end of the helical spring of the support means (S).

14. The waterbed structure set forth in claim 1 wherein the coupling means (T) is a female hose coupling unit fixed to and carried by the drain tube (23), said structure further includes an elongate flexible drain hose (H) with inner and outer ends, a male hose coupling unit at its inner end engaged with the coupling means (T), and, a pump means (A) engaged with the outer end of the drain hose (H) and moving water from within the mattress (M) through the drain fitting (D) and hose (H) and discharging it to waste; said pump means (A) is an aspirator pump connected with a valve-controlled pressurized water supply (W) that delivers motive water to the pump means (A); said waterbed structure further includes support means (S) within the drain tube (23) to prevent buckling of the drain tube (T) when it is bent from its normal horizontal position to its upturned position and that prevents the drain tube (23) from collapsing when subjected to minus pressures generated by the pump means A, said support means (S) is an elongate resilient helical spring engaged in and extending longitudinally through the drain tube (23); said spacer means (S) is an elongate resilient helical spring with an outer end portion engaged through the neck (24) and into the inner end of the drain tube (23) with convolutions at its outer end rotatably advanced into interengaged coupled engagement with convolutions at the inner end of the helical spring of the support means (S); said neck (24) includes a radially outwardly projecting mounting flange (20) at its inner end, said flange (20) overlies the outer surface of the side wall (12) about the drain opening (22) and is sealingly fixed thereto.

15. The waterbed structure set forth in claim 1 wherein the coupling means (T) is a female hose coupling unit fixed to and carried by the drain tube (23), said structure further includes an elongate flexible drain hose (H) with inner and outer ends, a male hose coupling unit at its inner end engaged with the coupling means (T), and, a pump means (A) engaged with the outer end of the drain hose (H) and moving water from within the mattress (M) through the drain fitting (D) and hose (H) and discharging it to waste; said pump means (A) is an aspirator pump connected with a valve-controlled pressurized water supply (W) that delivers motive water to the pump means (A); said waterbed structure further includes support means (S) within the drain tube (23) to prevent buckling of the drain tube (23) when it is bent from its normal horizontal position to its upturned position and that prevents the drain tube (23) from collapsing when subjected to minus pressures generated by the pump means (A), said support means (S) is an elongate resilient helical spring engaged in and extending longitudinally through the drain tube (23); said spacer means (S') is an elongate resilient helical spring with an outer end portion engaged through the neck (24) and into the inner end of the drain tube 23 with convolutions at its outer end rotatably advanced into interengaged coupled engagement with convolutions at the inner end of the helical spring of the support means (S); said neck (24) includes a radially outwardly projecting mounting flange (20) at its inner end, said flange (20) overlies the outer surface of the side wall (12) about the drain opening (22) and is sealingly fixed thereto; the drain tube (23), neck (24) and flange (20) are portions of a unitary part molded of a soft flexible material that is compatible with the material of which the mattress (M) is made, the flange (20) is fixed to the side wall (12) of the mattress (M) about the drain opening (22) therein by thermal welding.

16. The waterbed structure set forth in claim 1 wherein the drain tube (23') is a length of flexible reinforced hose, the inner end of the drain tube (23') and outer end of the neck (24') are connected together by mating hose coupling parts (T'') carried by the drain tube (23') and the neck (24').

* * * * *